US007977303B2

(12) United States Patent
Woo et al.

(10) Patent No.: US 7,977,303 B2
(45) **Date of Patent: *Jul. 12, 2011**

(54) MULTIPLE USE FABRIC CONDITIONING BLOCK WITH INDENTATIONS

(75) Inventors: Rick Ah-Man Woo, Hamilton, OH (US); Toan Trinh, Maineville, OH (US); Charles Michael Hardy, Norwood, OH (US); Kurt Alfred Karussi, Cincinnati, OH (US); Samuel James Morris, III, Cincinnati, OH (US); Lawrence Andrew Schumacher, Trenton, OH (US); John William Smith, Milford, OH (US); Jacqueline Marie Duderstadt, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1074 days.

This patent is subject to a terminal disclaimer.

(21) Appl. No.: 11/059,200

(22) Filed: Feb. 16, 2005

(65) Prior Publication Data

US 2005/0202999 A1 Sep. 15, 2005

Related U.S. Application Data

(60) Provisional application No. 60/548,374, filed on Feb. 27, 2004, provisional application No. 60/550,555, filed on Mar. 5, 2004, provisional application No. 60/550,669, filed on Mar. 5, 2004, provisional application No. 60/550,557, filed on Mar. 5, 2004, provisional application No. 60/555,860, filed on Mar. 24, 2004, provisional application No. 60/555,950, filed on Mar. 24, 2004, provisional application No. 60/560,121, filed on Apr. 7, 2004, provisional application No. 60/591,032, filed on Jul. 26, 2004.

(51) Int. Cl.
*C11D 17/00* (2006.01)

(52) U.S. Cl. ..... 510/519

(58) Field of Classification Search ..... 510/519
See application file for complete search history.

(56) References Cited

U.S. PATENT DOCUMENTS

| | | | | |
|---|---|---|---|---|
| 2,423,435 | A * | 7/1947 | Block | 510/440 |
| 3,043,015 | A | 7/1962 | Brucken | |
| 3,159,465 | A | 12/1964 | Morey | |
| 3,197,884 | A | 8/1965 | Smith | |
| 3,242,584 | A | 3/1966 | Jacobs | |
| 3,267,701 | A | 8/1966 | Mandarino | |
| 3,394,467 | A | 7/1968 | Donald | |
| 3,435,537 | A | 4/1969 | Rumsey, Jr. | |
| 3,634,947 | A | 1/1972 | Furgal | |

(Continued)

FOREIGN PATENT DOCUMENTS

CA 1021559 11/1977

(Continued)

OTHER PUBLICATIONS

PCT International Search Report date mailed Jun. 24, 2005, 11 pages.

(Continued)

*Primary Examiner* — John R Hardee
(74) *Attorney, Agent, or Firm* — Gary J Foose; David V Upite; Mark A Charles

(57) ABSTRACT

Multiple use fabric conditioning blocks comprising indentations and/or protrusions are useful for conditioning fabric.

14 Claims, 4 Drawing Sheets

U.S. PATENT DOCUMENTS

| | | | | |
|---|---|---|---|---|
| 3,676,199 | A | 7/1972 | Hewitt et al. | |
| 3,696,034 | A | 10/1972 | Hewitt et al. | |
| 3,698,095 | A | 10/1972 | Grand et al. | |
| 3,702,030 | A | 11/1972 | Janke | |
| 3,736,668 | A | 6/1973 | Dillarstone | |
| 3,870,145 | A | 3/1975 | Mizuno | |
| 3,895,128 | A | 7/1975 | Gaiseret al. | |
| 3,936,384 | A * | 2/1976 | Williams | 510/148 |
| 3,945,936 | A | 3/1976 | Lucas et al. | |
| 3,947,971 | A | 4/1976 | Bauer | |
| 3,948,387 | A | 4/1976 | Haertle | |
| 3,967,008 | A | 6/1976 | Mizuno et al. | |
| 3,977,980 | A | 8/1976 | Fry et al. | |
| 4,004,685 | A | 1/1977 | Mizuno et al. | |
| 4,012,326 | A | 3/1977 | Rudy et al. | |
| 4,014,105 | A | 3/1977 | Furgal et al. | |
| 4,014,432 | A * | 3/1977 | Clothier et al. | 206/0.5 |
| 4,035,307 | A | 7/1977 | Fry et al. | |
| 4,041,205 | A | 8/1977 | Compa et al. | |
| 4,053,992 | A | 10/1977 | Furgal | |
| 4,057,673 | A | 11/1977 | Falivene | |
| 4,098,937 | A | 7/1978 | Mizuno et al. | |
| 4,105,813 | A | 8/1978 | Mizuno et al. | |
| 4,108,600 | A | 8/1978 | Wong | |
| 4,130,392 | A | 12/1978 | Diehl et al. | |
| 4,137,345 | A | 1/1979 | Falivene | |
| 4,149,977 | A | 4/1979 | Morganson et al. | |
| 4,214,038 | A | 7/1980 | McCarty et al. | |
| 4,223,029 | A | 9/1980 | Mahler et al. | |
| 4,231,166 | A | 11/1980 | McMillan | |
| 4,254,139 | A | 3/1981 | Hendrickson et al. | |
| 4,259,373 | A | 3/1981 | Demessemaekers et al. | |
| 4,328,110 | A | 5/1982 | Green | |
| 4,385,452 | A | 5/1983 | Deschaaf et al. | |
| 4,422,247 | A | 12/1983 | Deschaaf | |
| 4,423,105 | A | 12/1983 | Dillarstone et al. | |
| 4,460,644 | A | 7/1984 | Pavlich | |
| 4,507,080 | A | 3/1985 | Freze | |
| 4,511,495 | A | 4/1985 | Melville | |
| 4,532,719 | A | 8/1985 | Davies et al. | |
| 4,532,722 | A | 8/1985 | Sax | |
| 4,567,675 | A | 2/1986 | Rennie | |
| 4,597,191 | A | 7/1986 | Juzefczyk | |
| 4,642,258 | A | 2/1987 | Majewski et al. | |
| 4,642,908 | A | 2/1987 | Brenner | |
| 4,706,802 | A | 11/1987 | Leigh | |
| 4,749,596 | A | 6/1988 | Evans et al. | |
| 4,769,159 | A | 9/1988 | Copeland | |
| 4,808,086 | A | 2/1989 | Evans et al. | |
| 4,849,257 | A | 7/1989 | Borcher et al. | |
| 4,891,890 | A | 1/1990 | Church | |
| 4,920,662 | A | 5/1990 | Seeburger | |
| 5,020,240 | A | 6/1991 | Lee | |
| 5,116,656 | A | 5/1992 | Morris et al. | |
| 5,208,089 | A | 5/1993 | Norris et al. | |
| 5,480,567 | A | 1/1996 | Lam et al. | |
| 5,500,137 | A | 3/1996 | Bacon et al. | |
| 5,510,042 | A | 4/1996 | Hartman et al. | |
| 5,668,094 | A | 9/1997 | Bacon et al. | |
| 5,675,911 | A | 10/1997 | Moser | |
| 5,687,591 | A | 11/1997 | Siklosi et al. | |
| 5,783,552 | A | 7/1998 | Trinh et al. | |
| 5,787,606 | A | 8/1998 | Bokholdt | |
| 5,940,988 | A | 8/1999 | Eisen | |
| 5,966,831 | A | 10/1999 | Anderson | |
| 6,107,270 | A | 8/2000 | Smith et al. | |
| 6,243,969 | B1 | 6/2001 | Yeazell | |
| 6,357,137 | B1 | 3/2002 | Childs et al. | |
| 6,883,723 | B2 * | 4/2005 | Griese et al. | 239/43 |
| 6,887,524 | B2 | 5/2005 | Aouad et al. | |
| 6,887,841 | B2 | 5/2005 | Mattia et al. | |
| 6,899,281 | B1 | 5/2005 | Griese et al. | |
| 6,910,640 | B2 * | 6/2005 | Griese et al. | 239/43 |
| 7,055,761 | B2 | 6/2006 | Griese et al. | |
| 7,066,412 | B2 | 6/2006 | Conley et al. | |
| 7,087,572 | B2 | 8/2006 | Hubig et al. | |
| 7,093,772 | B2 | 8/2006 | Griese et al. | |
| D536,824 | S | 2/2007 | Karussi et al. | |
| 7,311,267 | B2 | 12/2007 | Griese et al. | |
| 2002/0032147 | A1 | 3/2002 | Foley et al. | |
| 2002/0078589 | A1 | 6/2002 | Hagemann et al. | |
| 2003/0013632 | A1 | 1/2003 | Santos et al. | |
| 2003/0050220 | A1 | 3/2003 | Trinh et al. | |
| 2003/0192197 | A1 | 10/2003 | Griese et al. | |
| 2003/0195130 | A1 | 10/2003 | Lentsch et al. | |
| 2004/0006730 | A1 | 1/2004 | Cho et al. | |
| 2004/0045187 | A1 | 3/2004 | Curry et al. | |
| 2004/0089731 | A1 | 5/2004 | Griese et al. | |
| 2004/0159006 | A1 | 8/2004 | Griese et al. | |
| 2004/0167056 | A1 | 8/2004 | Lentsch et al. | |
| 2004/0222313 | A1 | 11/2004 | Lentsch et al. | |
| 2004/0256481 | A1 | 12/2004 | Griese et al. | |
| 2008/0072448 | A1 | 3/2008 | Hubig et al. | |

FOREIGN PATENT DOCUMENTS

| | | |
|---|---|---|
| DE | 2 350 574 | 4/1974 |
| EP | 0 000 416 A1 | 1/1979 |
| EP | 0 154 359 B1 | 9/1985 |
| WO | WO 98/27191 | 6/1998 |
| WO | WO 03/087282 A1 | 10/2003 |
| WO | WO 03/087463 A1 | 10/2003 |

OTHER PUBLICATIONS

Office Action for Application U.S. Appl. No. 11/059,100, date mailed Jun. 15, 2007.

Office Action for Application U.S. Appl. No. 11/059,100, date mailed Jan. 16, 2008.

Office Action for Application U.S. Appl. No. 11/059,092, date mailed May 24, 2007.

Office Action for Application U.S. Appl. No. 11/059,092, date mailed Nov. 21, 2007.

Office Action for Application U.S. Appl. No. 11/059,092, date mailed Jun. 6, 2008.

Notice of Allowance for Application U.S. Appl. No. 11/059,092, date mailed Mar. 17, 2009.

Office Action for Application U.S. Appl. No. 11/059,078, date mailed May 24, 2007.

Office Action for Application U.S. Appl. No. 11/059,078, date mailed Aug. 6, 2007.

* cited by examiner

MULTIPLE USE FABRIC CONDITIONING BLOCK WITH INDENTATIONS

CROSS-REFERENCE TO RELATED APPLICATIONS

This application claims benefit to the following U.S. Provisional Patent Applications: 60/548,374, filed Feb. 27, 2004; 60/550,555, filed Mar. 5, 2004; 60/550,669, filed Mar. 5, 2004; 60/550,557, filed Mar. 5, 2004; 60/555,860 filed Mar. 24, 2004; 60/555,950 filed Mar. 24, 2004; 60/560,121, filed Apr. 7, 2004; and 60/591,032, filed Jul. 26, 2004, the disclosures of which are all hereby incorporated by reference.

FIELD OF THE INVENTION

The invention relates to an improved multiple use fabric conditioning block and to methods using and manufacturing the same.

BACKGROUND OF THE INVENTION

Dryer-added fabric conditioning products provide a better convenience to the consumer as compared to the rinse-added fabric conditioning products because they spare the consumer the requirement of having to be present right at the beginning of the rinse cycle.

There are two main types of dryer-added fabric conditioning products, namely, single use products and multiple-use products. Single use products, most commonly in the sheet form coated with a fabric conditioning active composition, calls for adding a single sheet into an automatic clothes dryer containing a wet laundry load, at the beginning of the drying cycle. Examples of this type of product are disclosed in U.S. Pat. No. 3,442,692 to Gaiser and U.S. Pat. No. 3,686,025 to Morton et al.

Multiple-use fabric conditioning products are placed in the interior of the dryer to release the fabric conditioning active to successive laundry loads. Each multiple-use product lasts many drying cycles, from a few cycles to about 50 or more cycles, and thus provides a better convenience to the consumer than single use products. Said product can either be an unattached article that is added to an automatic clothes dryer and is tumbled along with a wet laundry load, or an article that is releasably attached to the interior of an automatic dryer drum. An example of an unattached multiple use fabric conditioning article is disclosed in U.S. Pat. No. 3,676,199 issued Jul. 11, 1972 to Hewitt et al.

Another type of multiple-use products consists of a dispenser that is attached to the interior of an automatic clothes dryer to dispense a fabric conditioning active to successive laundry loads. Said dispenser can have a permeable surface and containing a fabric conditioning block that is softenable at the operating temperature of said clothes dryer, as is disclosed, e.g., in U.S. Pat. No. 3,967,008 issued Jun. 29, 1976 and U.S. Pat. No. 4,004,685 issued Jan. 25, 1977, both to Mizuno et al., and U.S. Pat. No. 4,149,977 issued Apr. 17, 1979 to Morganson et al. A preferred type of multiple-use products has the conditioning active not covered by a permeable surface, but is instead exposed to be transferred to the fabric. The product is attached to the interior of the dryer, as disclosed in U.S. Pat. No. 3,696,034 issued Oct. 3, 1972, U.S. Pat. Appl. Publ. No. 2003/0192197 A1 published Oct. 16, 2003 to Griese et al., and U.S. Pat. Appl. Publ. No. 2003/0195130 A1 published Oct. 16, 2003 to Lentsch et al. The softener active, which is solid at room temperature, only softens at a temperature above the clothes dryer operating temperature, as is disclosed in U.S. Pat. Appl. Publ. Nos. 2003/0192197 and 2003/0195130 A1.

While the multiple-use dryer-added conditioning products disclosed in the art can provide an improved convenience, they do have some performance issues. One continuing problem is the varying amount of conditioning active that is released to the fabric, as a function of number of cycles that the products have been used. For instance, U.S. Pat. No. 4,149,977 discusses the need to control the dispensing rate or the consumption rate (Col. 6-8). One means that can be used to regulate the dispensing rate is to select an appropriate conditioning composition, as disclosed in U.S. Pat. No. 4,149,977, issued Apr. 17, 1979 to Morganson et al. U.S. Pat. Appl. Publ. No. 2003/0192197 discloses that the product releases the most active in the earlier drying cycles, and the shape of the product affects the dispensing rate of the product (FIG. 20, and sections [0059] to [0061]). It discloses that a product with a softener block having square edges dispenses more conditioning active at the initial drying cycles than a product with a softener block having rounded edges, thus a product with rounded edges is more preferred to provide a more even dispensing from cycle to cycle, even though the difference between the initial cycles and the late cycles is still very substantial.

There still is a need for further improving the release rate of the fabric conditioning active from cycle to cycle of the multiple use fabric conditioning block.

SUMMARY OF THE INVENTION

One aspect of the invention provides a multiple use fabric conditioning block comprising: (a) a first side comprising at least one indentation or protrusion; (b) a fabric conditioning composition comprising (1) a fabric conditioning component; and (2) a carrier component; and optionally (3) a perfume component.

Another aspect of the invention provides for a method of softening a fabric comprising the step of contacting said fabric with a multiple use fabric conditioning block according to the first aspect of the invention.

BRIEF DESCRIPTION OF THE DRAWINGS

The drawings are only for purposes of illustrating the preferred embodiments and are not to be construed as limiting the invention.

DETAILED DESCRIPTION OF THE INVENTION

Figure 1:
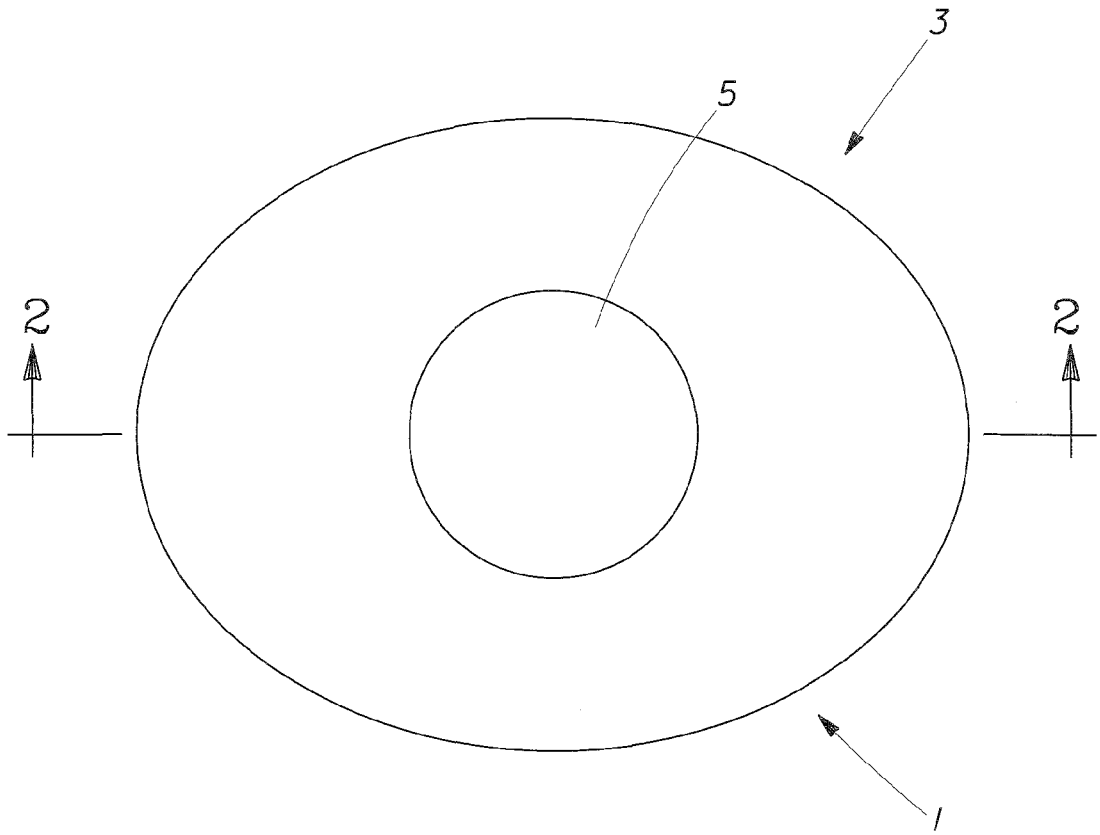
FIG. 1 is a top view of one embodiment of a multiple use fabric conditioning block comprising an indentation.

"Indentation," is used herein in the broadest sense, and refers to any recess, notch, groove, dimple, angular or V-shaped cut, valley, concavity, pocket, or depression of a first side of a multiple use fabric conditioning block. The first side of the block is the surface of the block that is generally visible to the user and generally comes into contact with laundry during drying laundry.

"Fabric conditioning block" or "fabric conditioning bar" is used herein in the broadest sense, and refers to any solid form, chunk, slab, wedge, lump, etc., comprising a fabric conditioning composition that is solid at the operating temperature of automatic clothes dryers, said composition exhibits a melting point greater than about 90° C.

"Fabric conditioning composition" means a composition that comprises a fabric conditioning component and a carrier component, and optionally, but preferably a perfume component, wherein said composition exhibits a melting point greater than about 90° C. The fabric conditioning component comprises a fabric conditioning active, and provides fabric conditioning properties to laundry such as fabric softening or antistatic. A general type of fabric conditioning active that can be used according to the invention can be referred to as quaternary ammonium compounds, alternatively quaternary ammonium compounds and diluents, e.g., surfactants. The carrier component mixes with the fabric conditioning component and helps the fabric conditioning component resist transfer to laundry by melting during the drying operation.

The term "multiple use" means the fabric conditioning block may be used to deliver a desired amount of fabric conditioning composition to laundry during at least two cycles for drying laundry, preferably at least about 10 cycles, more preferably at least about 20 cycles, even more preferably at least about 30 cycles, yet more preferably at least about 40 cycles, and again even more preferably at least about 50 cycles, alternatively at least about 60 cycles, before the fabric conditioning block needs to be replaced.

"Protrusion," is used herein in the broadest sense, and refers to any projection, protuberant, protuberance, prominence, bulge, embossment, convexity, ridge, or excurature of a first side of a multiple use fabric conditioning block. For purposes of the present invention, a "protrusion," as used herein, does not include an overall dome shape of the first surface of the block.

For purposes of the present invention, the terms "indentation" and "protrusion" do not include those areas created from occasional defects in the manufacturing process of multiple use fabric conditioning blocks and compositions of the prior art. These incidental defects in the manufacturing process may include those associated with production, packaging, and/or handling of the block, including, e.g., cracks, chips, open bubbles, ripples caused by, e.g., shrinkage of the fabric conditioning block during the solidification of the molten composition, and the like. In an embodiment of the present invention where the multiple use fabric conditioning composition is molded, such indentations and/or protrusions of the present invention will be evident in the mold.

The indentation and/or protrusions of the present invention can be angled, sloped, and/or beveled, and can be smooth and/or having step-like patterns.

The indentation may have an indentation depth. The indentation depth is measured from a bottom point to an apex point. The bottom point is the point deepest in the indentation whereas the apex point is the highest point of the indentation. The elevation difference between the bottom point and apex point is the indentation depth. The indentation depth can be of from about 1 mm to about 20 mm, preferably from about 2 mm to about 15 mm, and more preferably from about 3 mm to about 10 mm. An indentation depth may be measured perpendicularly with respect to a base, or it can be measured in a cross section of the block. Alternatively, the indentation can have a thickness percentage relative to the maximum thickness of the block, measured perpendicularly with respect to a base, or it can be measured in a cross section of the block. The indentation can have a depth of up to about 90%, up to about 80%, up to about 70%, up to about 60%, up to about 50%, of the maximum thickness of the block, or in a cross section of the block. Lastly, the indentation can have a volume, wherein volume can be from about 1% to about 50%, preferably from about 2% to about 40%, and more preferably from about 3% to about 30%, of the total volume of the block, wherein said total volume of the block is defined as the space between the first side and the second side which is the base of the block. Volume may be obtained by any one of the methods known in the art.

Similarly, the protrusion may have a protrusion height. The protrusion height is measured from a bottom point to an apex point. The bottom point is the point lowest at the base of the protrusion whereas the apex point is the highest point of the protrusion. The elevation difference between the bottom point and apex point is the protrusion height. The protrusion can have a protrusion height of from about 1 mm to about 20 mm, preferably from about 2 mm to about 15 mm, and more preferably from about 3 mm to about 10 mm.

The indentations and/or the protrusions can be cast using a mold as part of the block making. The indentations can also be imprinted, impressed, or stamped, all using either hot or cold methods, on the surface of the already cast block, or in combination with other indentations and/or protrusions that are cast with a mold.

Although not to be bound to any theory, it is believed that the indentations and/or the protrusions of the first side of the multiple use fabric conditioning block of the present invention reduce the contact surface area of a new block with the drying laundry that is tumbling in the dryer. As the fabric conditioning composition is abraded off from the block in subsequent drying cycles, the contact surface area of the fabric conditioning block can increase with the number of cycles, or at least compensate for the overall decrease of overall first side surface area. This has the effect of modulating the release rate of the fabric conditioning composition from drying cycle to drying cycle of the multiple use fabric conditioning block.

The indentation(s) and/or the protrusion(s) of the present invention can comprise sharp edges or can comprise smooth edges. In one embodiment the indentations and/or protrusions comprise geometrical design and/or shape. In another embodiment, the indentations and/or protrusions collectively comprise an indicium to enhance the visual aesthetics of the block. In a preferred embodiment, the indicium comprises a word, phrase, letter, character, brand name, company name, company logo or symbol, description, logo, icon, perfume name, design, designer name, company name, company logo, symbol, motif, insignia, figure, mark, signal, texture, shape, advertisement, or combinations thereof. In a preferred embodiment, the indicium comprises a word, phrase, letter, character, brand name, company name, perfume name, description, or combinations thereof, wherein said indicium is preferably in one or more than one language. In an alternative embodiment, the indentations and/or protrusions collectively comprise a wave or sinusoidal topology of the first side of the block.

In another embodiment, the multiple use fabric conditioning block comprises a first side, wherein said first side comprises at least one cross section comprising (a) an outline course of said cross section; wherein the outline course comprises a starting point, an end point, and a plurality of successive points between the starting point and the end point; and (b) a tangent at each successive point beginning at the starting point and ending at the end point; wherein the tangents of the outline course comprising a direction of rotation; and wherein the direction of rotation changes at least once, preferably at least two times, alternatively at least three times, alternatively at least four times, indicates an indentation or a protrusion. The starting point and end point can be at the same or different location. The "cross section," as used herein, can be any one cross section comprising the first side of the block, e.g., through x, y, z space. A cross section may include an x plane, or y plane, or z plane, or a plane comprising two or more x, y, or z elements. The cross section can be longitudinal, latitudinal, vertical, traverse, or slanted.

In yet another embodiment, the multiple use fabric conditioning block comprises a first side, wherein the first side comprises at least one cross section comprising an outline course of said cross section, wherein outline course comprises at least one concavity and at least one convexity. The terms "concavity" and "convexity" are intended to encompass step-like patterns

FIGURES

FIG. 1 is a top view of a first embodiment of a multiple use fabric conditioning block 1 of the present invention. The top view is a first side 3 of the block 1 with an indentation 5. An axis 1-1 runs through the center of the indentation 5 longitudinally.

Figure 2:
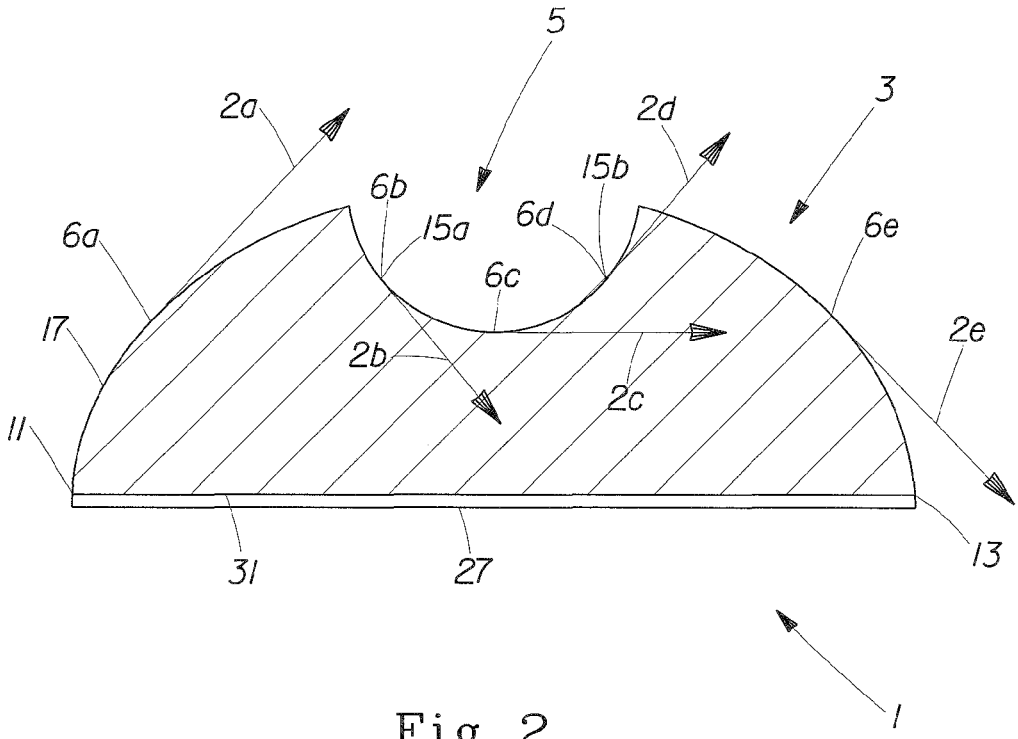
FIG. 2 is a longitudinal vertical cross section of the embodiment of FIG. 1.

FIG. 2 is a longitudinal cross section taken along axis 1-1 of FIG. 1 of the embodiment of FIG. 1 with a first side 3 of the block 1 comprising an indentation 5. An outline course 17 of the cross section begins at starting point 11 and finishes at end point 13, and has a plurality of successive points 6*a*-6*e* therebetween. Although the plurality of successive points 6*a*-6*e* of FIG. 1 is not drawn to scale for purposes of illustration, the successive points 6*a*-6*e* are ideally spaced about 0.5 mm, or closer, for optimal resolution. A tangent 2 is at each successive point 6 beginning at the starting point 11, ending at the endpoint 13, comprising a direction of rotation. The direction of rotation may be either clockwise or counterclockwise depending upon the location of the starting point 11 and ending point 13, or type of cross section, and most notably, if there is an indentation or protrusion. Given the staring point 11 is at the left side of the FIG. 2, tangents 2*a* and 2*b*, at successive points 6*a* and 6*b*, respectively, successively rotates are in a clockwise direction. However, successive point 6*b* is also a first point of inflection 15*a*. A point of inflection is the point along the outline course 17 where the tangent changes its direction of rotation. As such, tangents 2*b*, 2*c*, and 2*d*, at successive points 6*b*, 6*c*, and 6*d*, respectively, have a counterclockwise direction of rotation. Successive point 6*d* is also a second point of inflection 15. As such, tangents 2*d*, and 2*e* at successive points 6*d* and 6*e*, respectively, have a clockwise direction of rotation. Lastly, a schematic representation of a block carrier 27 is operably connected to a second side 31, which is the base of the block 3.

Figure 3:
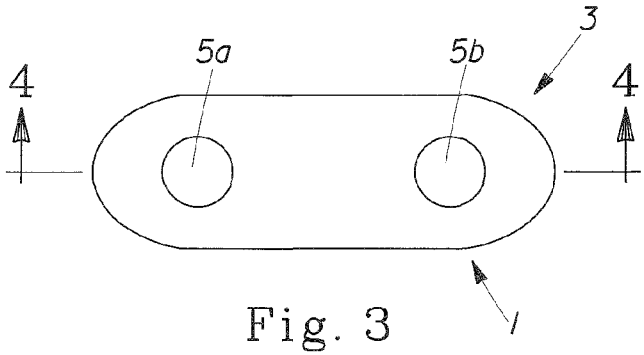
FIG. 3 is a top view of a second embodiment of a block comprising two indentations.

FIG. 3 is a top view of a first side 3 of the block 1 with two indentations 5*a*, 5*b* of a second embodiment of the invention. An axis 3-3 runs longitudinally through the center of indentations 5*a*, 5*b*.

Figure 4:
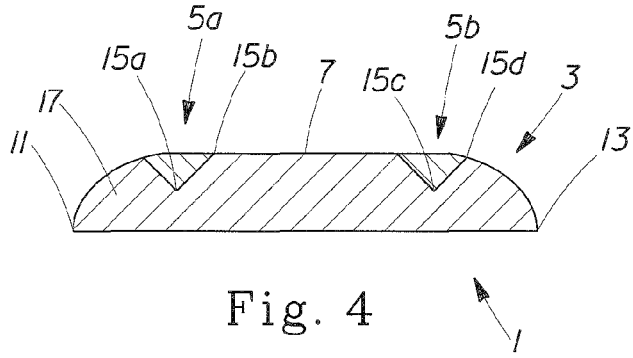
FIG. 4 a vertical longitudinal cross section of the embodiment of FIG. 3.

FIG. 4 is a longitudinal cross section taken along axis 3-3 of FIG. 3 of the embodiment of FIG. 3 with a first side 3 of a block 1 comprising an outline course 17, and indentations 5*a* and 5*b*. The outline course 17 comprises a starting point 11 and an ending point 13, with a plurality of successive points (not shown) therebetween. A tangent (not shown) is at each successive point beginning at the starting point 11, ending at the end point 13, and comprising a direction of rotation. Beginning at the starting point 11, the tangent along the outline course 17 rotates in a clockwise direction until reaching a first inflection point 15*a*, where the tangent changes direction of rotation to a counterclockwise direction. The tangent, thereafter, upon reaching a second inflection point 15*b*, changes direction of rotation to a clockwise direction until reaching a third inflection point 15*c* wherein the tangent again changes direction of rotation to a counterclockwise direction. Finally, upon reaching the fourth and final inflection point 15*d*, the tangent changes direction of rotation to a clockwise direction once more. At least one protrusion 7 is also shown.

Figure 5:
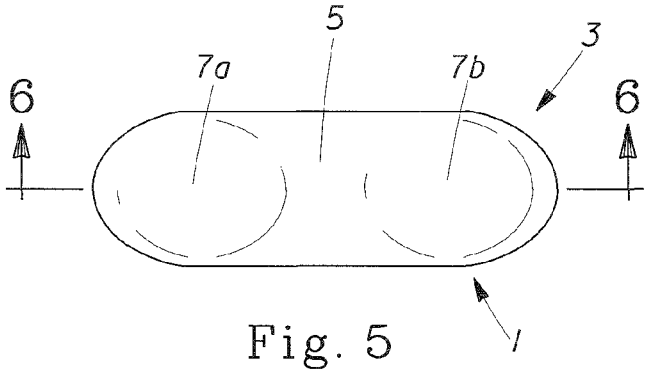
FIG. 5 is a top view of a third embodiment of a block comprising two protrusions and one indentation.

FIG. 5 is a top view of a first side 3 of the block 1 with protrusions 7*a*, 7*b* and indentation 5 of a third embodiment of the invention. An axis 5-5 runs longitudinally through the center of protrusions 7*a*, 7*b* and indentation 5.

Figure 6:
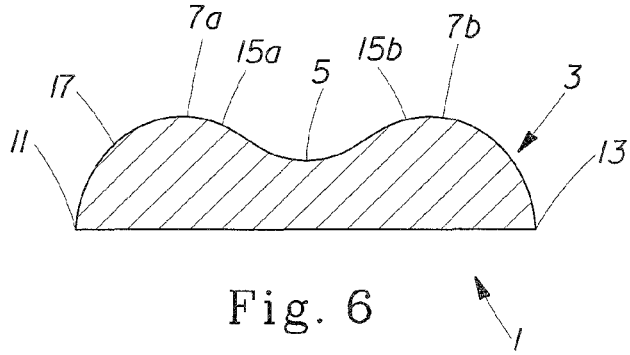
FIG. 6 is a vertical longitudinal cross section of the embodiment of FIG. 5.

FIG. 6 is a longitudinal cross section taken along axis 5-5 of FIG. 5 of the embodiment of FIG. 5 with a first side 3 of a block 1 comprising an outline course 17, protrusions 7*a*, 7*b*, and indentation 5. The outline course 17 comprises a starting point 11 and an ending point 13, with a plurality of successive points (not shown) therebetween. A tangent (not shown) is at each successive point beginning at the starting point 11, ending at the end point 13, and comprising a direction of rotation. Beginning at the starting point 11, the tangent along the outline course 17 rotates in a clockwise direction until reaching a first inflection point 15*a*, where the tangent changes direction of rotation to a counterclockwise direction. The tangent, thereafter, upon reaching a second and final inflection point 15*b*, changes direction of rotation back to a clockwise direction again.

Figure 7:
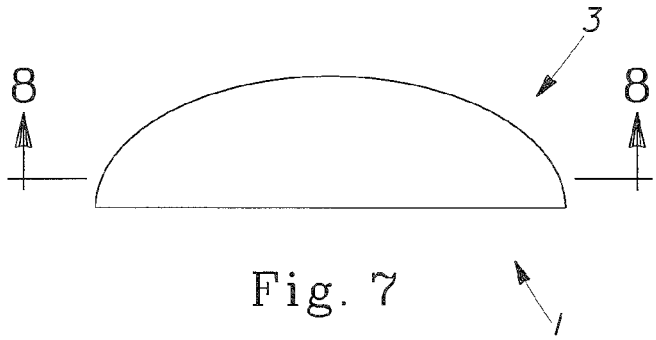
FIG. 7 is a side view of a fourth embodiment of a block comprising two indentations.

FIG. 7 is a side view of a first side 3 of the block 1 of another embodiment of the invention. An axis 7-7 runs horizontally longitudinal through the block 1.

Figure 8:
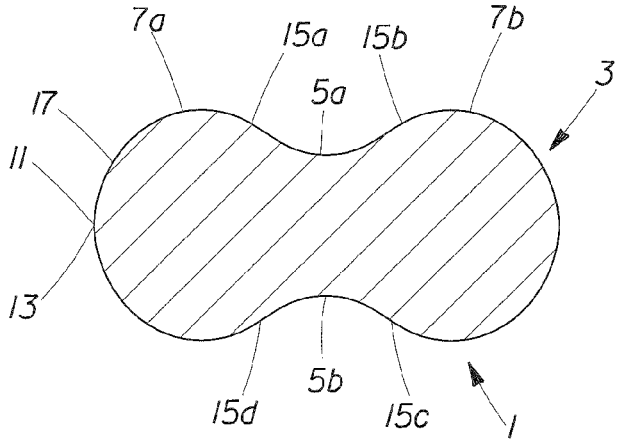
FIG. 8 is a horizontal longitudinal cross section of the embodiment of FIG. 7.

FIG. 8 is a horizontal cross section taken along axis 7-7 of FIG. 7 of the embodiment of FIG. 7 with a first side 3 of a block 1, comprising an outline course 17, at least two protrusions 7*a*, 7*b*, and two indentations 5*a*, 5*b*. The outline course 17 comprises a starting point 11 and an ending point 13, wherein the starting point and ending point occupy the same point, with a plurality of successive points (not shown) therebetween. A tangent (not shown) is at each successive point beginning at the starting point 11, ending at the end point 13, and comprising a direction of rotation. Beginning at the starting point 11, the tangent along the outline course 17 rotates in a clockwise direction until reaching a first inflection point 15*a*, where the tangent changes direction of rotation to a counterclockwise direction. The tangent, thereafter, upon reaching a second inflection point 15*b*, changes direction of rotation to a clockwise direction until reaching a third inflection point 15*c* wherein the tangent again changes direction of rotation to a counterclockwise direction. Finally, upon reaching the fourth and final inflection point 15*d*, the tangent changes direction of rotation to a clockwise direction once more.

Figure 9:
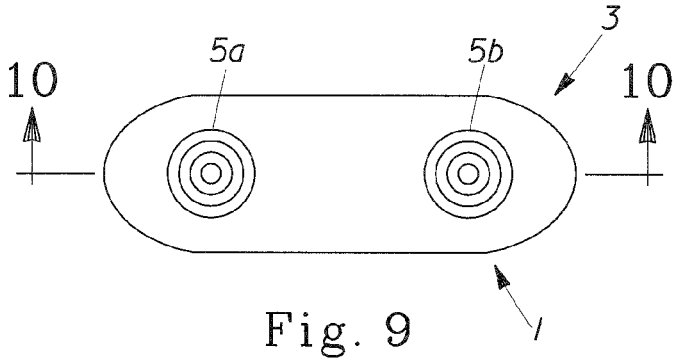
FIG. 9 is a top view of a fifth embodiment of a block comprising two indentations.

FIG. 9 is a top view of a first side 3 of the block 1 with two indentations 5*a*, 5*b* of a fifth embodiment of the invention. An axis 5-5 runs longitudinally through the center of indentations 5*a*, 5*b*.

Figure 10:
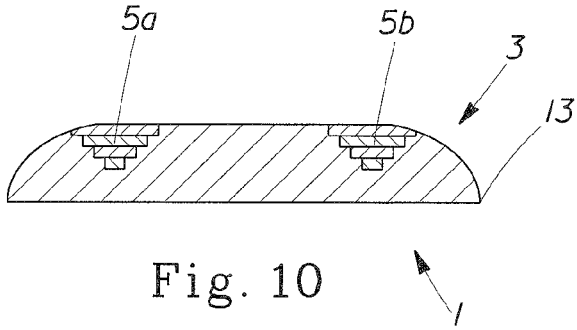
FIG. 10 is a longitudinal cross section of the embodiment of FIG. 9.

FIG. 10 is a longitudinal cross section taken along axis 9-9 of FIG. 9 of the embodiment of FIG. 7 with a first side 3 of a block 1, comprising indentations 5*a*, 5*b* that comprise stepwise concentric circles.

Carrier Component

The carrier component mixes with the fabric conditioning component and helps the fabric conditioning component resist transfer to laundry by melting during the drying operation. The carrier component is chosen so that the multiple use fabric conditioning composition exhibits a melting point or softening point that is above the operating temperature of the dryer. Exemplary carrier components that can be used according to the invention include ethylene bisamides, primary alkylamides, alkanolamides, polyamides, alcohols containing at least 12 carbon atoms, alkoxylated alcohols containing alkyl chain of at least 12 carbon atoms, carboxylic acids containing at least 12 carbon atoms, and derivatives thereof. In most dryer operations, this means that the melting temperature of the composition is above about 90° C. The melting temperature or the softening temperature of the composition can be above about 95° C., above about 100° C., above about 110° C., or above about 120° C. The melting temperature of the composition can be below about 200° C.

An exemplary weight ratio of fabric conditioning component to carrier component is from about 1:19 to about 19:1. The ratio of the fabric conditioning component to the carrier component can be from about 1:10 to about 10:1, and can be from about 3:7 to about 9:1. The fabric conditioning component can comprise a fabric conditioning active and can include the medium that may be present with the fabric conditioning active. Furthermore, the medium can be the same as or different from the carrier component.

In one embodiment, the multiple use fabric conditioning composition is a result of melt mixing the fabric conditioning component and the carrier component; and alternatively, also a perfume component.

Perfume Component

Another aspect of the invention provides for a perfume component. Fabric conditioning compositions in the art commonly contain perfumes to provide a good odor to fabrics. Typical perfume compounds and compositions can be found in the art including U.S. Pat. No. 4,145,184 issued Mar. 20, 1979 to Brain and Cummins; U.S. Pat. No. 4,209,417 issued Jun. 24, 1980 to Whyte; U.S. Pat. No. 4,515,705 issued May 7, 1985 to Moeddel; and U.S. Pat. No. 4,152,272 issued May 1, 1979 to Young.

In the multiple-use fabric conditioning composition art, the effect of perfume on the rate of release of the fabric conditioning composition is not known or not appreciated. Although not to be bound to any theory, it is believed that the neat perfume that is incorporated into a multiple-use fabric conditioning composition that goes through many heating and/or softening cycle can be depleted by diffusion and/or volatility. Furthermore, it is believed that during the life span of the block, the more volatile perfume ingredients diffuse faster and are depleted faster from the block. It is further believed that the neat perfume that is intimately blended in the solid fabric conditioning composition has the effect of softening that solid conditioning composition and increases the dispensing rate of the conditioning composition to the fabric. In earlier drying cycles, the solid composition contains proportionally more perfume thus is softer and releases more active to the fabric per cycle, as compared to later cycles, when the solid composition contains proportionally less perfume (due to a perfume loss) thus becomes harder and releases less active to the fabric per cycle. Therefore, it is believed that minimizing the neat perfume in the multiple use fabric conditioning composition, especially a neat perfume comprising a high level of high volatile perfume ingredients may help improve the evenness of the rate of release of the fabric conditioning composition throughout the different drying cycles.

Thus, in one embodiment, the multiple use fabric conditioning block comprising indentation(s) and/or protrusion(s) of the present invention additionally comprises a perfume component comprising at least one of: (a) a low volatile perfume composition comprising at least about 25%, at least about 35%, at least about 45%, at least about 55%, at least about 65%, and at least about 75%, by weight of said perfume component, of perfume ingredients having a boiling point equal to or higher than about 250° C.; (b) perfume microcapsule comprising a perfume carrier and an encapsulated perfume composition; (c) pro-perfume; (d) low odor detection threshold perfume ingredients; and (e) mixtures thereof. Non-limiting examples of such perfume components are described in co-filed U.S. Provisional Application No. 60/550,555; filed Mar. 5, 2004; entitled "MULTIPLE USE FABRIC CONDITIONING COMPOSITION WITH IMPROVED PERFUME"; to Trinh et al., the U.S. non-provisional application thereof, and references cited therein.

Due to the high energy input and large air flow in the drying process used in the typical automatic clothes dryers, a large part of the perfume provided by such fabric conditioning products has been lost out the dryer vent. Even for the less volatile components, only a small fraction remains on the fabrics after the drying cycle. The loss of the highly volatile fraction of the perfume is much higher. Usually the loss of the highly volatile fraction is substantial, often practically total. However, some of the highly volatile perfume ingredients can provide a desirable fresh and clean impression to the fabrics, and it is highly desirable that these ingredients be deposited and present on the dried fabrics. It is now surprisingly discovered that some multiple use dryer-added fabric conditioning compositions can deliver a significantly higher level of volatile perfume ingredients than conventional dryer-added fabric conditioning products, such as dryer sheet products. Thus it is discovered that, when the same perfume composition comprising a high level of highly volatile perfume ingredients, referred hereinafter as "blooming perfume composition," is incorporated at a same level to the multiple use fabric conditioning composition of the present invention and to a conventional fabric conditioning composition that has a lower melting point and is coated to a substrate to form a dryer-added fabric conditioning sheet, the weight ratio of total blooming perfume ingredients vs. total substantive ingredients is significantly higher when the perfume is delivered from the multiple use fabric conditioning composition. However, it is believed that the blooming perfume may affect the release rate of the fabric conditioning composition with the number of drying cycles, the indentations and/or protrusions in such block may help improve the evenness of such rate of release of the fabric conditioning composition.

Thus, in another embodiment, the multiple use fabric conditioning block comprising indentation(s) and/or protrusion(s) of the present invention can additionally comprise a perfume component comprising a blooming perfume composition comprising at least about 25%, at least about 35%, at least about 45%, at least about 55%, at least about 65%, by weight of said perfume component, of perfume ingredients having a boiling point equal or lower than about 250° C. Non-limiting examples of such perfume components are described in co-filed U.S. Provisional Application No. 60/550,557 filed Mar. 5, 2004; entitled "MULTIPLE USE FABRIC CONDITIONING COMPOSITION WITH BLOOMING PERFUME"; to Morgan et al., the U.S. non-provisional application thereof, and references cited therein.

Typically the blooming perfume ingredient is chosen from allo-ocimene, allyl caproate, allyl heptoate, amyl propionate, anethol, anisic aldehyde, anisole, benzaldehyde, benzyl acetate, benzyl acetone, benzyl alcohol, benzyl butyrate, benzyl formate, benzyl iso valerate, benzyl propionate, beta gamma hexenol, camphene, camphor, carvacrol, laevo-carveol, d-carvone, laevo-carvone, cinnamyl formate, citral (neral), citronellol, citronellyl acetate, citronellyl isobutyrate, citronellyl nitrile, citronellyl propionate, cuminic alcohol, cuminic aldehyde, Cyclal C, cyclohexyl ethyl acetate, decyl aldehyde, dihydro myrcenol, dimethyl benzyl carbinol, dimethyl benzyl carbinyl acetate, dimethyl octanol, diphenyl oxide, ethyl acetate, ethyl aceto acetate, ethyl amyl ketone, ethyl benzoate, ethyl butyrate, ethyl hexyl ketone, ethyl phenyl acetate, eucalyptol, eugenol, fenchyl acetate, fenchyl alcohol, flor acetate (tricyclo decenyl acetate), frutene (tricyclo decenyl propionate), gamma methyl ionone, gamma-n-methyl ionone, gamma-nonalactone, geraniol, geranyl acetate, geranyl formate, geranyl isobutyrate, geranyl nitrile, hexenol, hexenyl acetate, cis-3-hexenyl acetate, hexenyl isobutyrate, cis-3-hexenyl tiglate, hexyl acetate, hexyl formate, hexyl neopentanoate, hexyl tiglate, hydratropic alcohol, hydroxycitronellal, indole, isoamyl alcohol, alpha-ionone, beta-ionone, gamma-ionone, alpha-irone, isobornyl acetate, isobutyl benzoate, isobutyl quinoline, isomenthol, isomenthone, isononyl acetate, isononyl alcohol, para-isopropyl phenylacetaldehyde, isopulegol, isopulegyl acetate, isoquinoline, cis-jasmone, lauric aldehyde (dodecanal), Ligustral, d-limonene, linalool, linalool oxide, linalyl acetate, linalyl formate, menthone, menthyl acetate, methyl acetophenone, methyl amyl ketone, methyl anthranilate, methyl benzoate, methyl benzyl acetate, methyl chavicol, methyl eugenol, methyl heptenone, methyl heptine carbonate, methyl heptyl ketone, methyl hexyl ketone, alpha-iso "gamma" methyl ionone, methyl nonyl acetaldehyde, methyl octyl acetaldehyde, methyl phenyl carbinyl acetate, methyl salicylate, myrcene, neral, nerol, neryl acetate, nonyl acetate, nonyl aldehyde, octalactone, octyl alcohol (octanol-2), octyl aldehyde, orange terpenes (d-limonene), para-cresol, para-cresyl methyl ether, para-cymene, para-methyl acetophenone, phenoxy ethanol, phenyl acetaldehyde, phenyl ethyl acetate, phenyl ethyl alcohol, phenyl ethyl dimethyl carbinol, alpha-pinene, beta-pinene, prenyl acetate, propyl butyrate, pulegone, rose oxide, safrole, alpha-terpinene, gamma-terpinene, 4-terpinenol, alpha-terpineol, terpinolene, terpinyl acetate, tetrahydro linalool, tetrahydro myrcenol, tonalid, undecenal, veratrol, verdox, vertenex, viridine, and mixtures thereof. Preferably the blooming perfume ingredient is chosen from allo-ocimene, allyl caproate, allyl heptoate, amyl propionate, anethol, anisole, benzaldehyde, benzyl acetate, benzyl acetone, benzyl alcohol, benzyl butyrate, benzyl formate, benzyl propionate, beta gamma hexenol, camphene, camphor, carvacrol, laevo-carveol, d-carvone, laevo-carvone, citral (neral), citronellol, citronellyl acetate, citronellyl nitrile, citronellyl propionate, cuminic aldehyde, Cyclal C, cyclohexyl ethyl acetate, decyl aldehyde, dihydro myrcenol, dimethyl benzyl carbinol, dimethyl octanol, ethyl acetate, ethyl aceto acetate, ethyl amyl ketone, ethyl benzoate, ethyl butyrate, ethyl hexyl ketone, ethyl phenyl acetate, eucalyptol, fenchyl acetate, fenchyl alcohol, flor acetate (tricyclo decenyl acetate), frutene (tricyclo decenyl propionate), gamma methyl ionone, gamma-nonalactone, geraniol, geranyl acetate, geranyl formate, geranyl isobutyrate, geranyl nitrile, hexenol, hexenyl acetate, cis-3-hexenyl acetate, hexenyl isobutyrate, cis-3-hexenyl tiglate, hexyl acetate, hexyl formate, hexyl neopentanoate, hexyl tiglate, hydratropic alcohol, hydroxycitronellal, isoamyl alcohol, alpha-ionone, beta-ionone, gamma-ionone, isobornyl acetate, isobutyl benzoate, isomenthol, isomenthone, isononyl acetate, isononyl alcohol, para-isopropyl phenylacetaldehyde, isopulegol, isopulegyl acetate, isoquinoline, Ligustral, d-limonene, linalool, linalool oxide, linalyl acetate, linalyl formate, menthone, menthyl acetate, methyl acetophenone, methyl amyl ketone, methyl anthranilate, methyl benzoate, methyl benzyl acetate, methyl chavicol, methyl eugenol, methyl heptenone, methyl heptine carbonate, methyl heptyl ketone, methyl hexyl ketone, alpha-iso "gamma" methyl ionone, methyl nonyl acetaldehyde, methyl octyl acetaldehyde, methyl phenyl carbinyl acetate, methyl salicylate, myrcene, neral, nerol, neryl acetate, nonyl acetate, nonyl aldehyde, octalactone, octyl alcohol (octanol-2), octyl aldehyde, orange terpenes (d-limonene), para-cresol, para-cresyl methyl ether, para-cymene, para-methyl acetophenone, phenoxy ethanol, phenyl acetaldehyde, phenyl ethyl acetate, phenyl ethyl alcohol, phenyl ethyl dimethyl carbinol, alpha-pinene, beta-pinene, prenyl acetate, propyl butyrate, pulegone, rose oxide, safrole, alpha-terpinene, gamma-terpinene, 4-terpinenol, alpha-terpineol, terpinolene, terpinyl acetate, tetrahydro linalool, tetrahydro myrcenol, undecenal, veratrol, verdox, vertenex, viridine, and mixtures thereof.

Exemplary fabric conditioning components, carrier components, and perfume components are described in U.S. patent application US 2003/0195130 and references cited therein, co-filed U.S. Provisional Application No. 60/550,555, filed Mar. 5, 2004; entitled "MULTIPLE USE FABRIC CONDITIONING COMPOSITION WITH IMPROVED PERFUME"; to Trinh et al., the U.S. non-provisional application thereof and references cited therein; and co-filed U.S. Provisional Application No. 60/550,557; filed Mar. 5, 2004; entitled "MULTIPLE USE FABRIC CONDITIONING COMPOSITION WITH BLOOMING PERFUME"; to Morgan et al., the U.S. non-provisional application thereof, and references cited therein.

Block Carrier

The multiple use fabric conditioning block of the present invention is preferably operably connectable to an inside surface of a dryer. In one embodiment, a fabric conditioning article is provided, wherein the article comprises: (a) a block carrier; (b) a multiple use fabric conditioning composition; wherein said article is operably connectable to an inside surface of a dryer. In an alternative embodiment, the block carrier is further operably connectable to a docking member wherein the docking member is operably connected to the inside surface of the dryer. A suitable block carrier and/or docking member is described in U.S. Provisional Application No. 60/548,374, filed Feb. 27, 2004; entitled "IMPROVED MULTIPLE USE FABRIC CONDITIONING ARTICLE WITH REPLACEMENT INDICIUM" to Trinh et al, the U.S. non-provisional application thereof, and the references cited therein; and US 2003/0192197 A1, and the references cited therein.

It should be understood that the term "laundry" refers to any textile or fabric material that is laundered. The dryers in which the multiple use fabric conditioning block according to the invention can be used include any type of automatic clothes dryer that uses heat and agitation to remove water from the laundry. An exemplary dryer includes a tumble-type dryer that is heated by electricity or gas, wherein the laundry is provided within a rotating drum that causes the laundry to tumble during the operation of the dryer.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

Except as otherwise noted, the articles "a," "an," and "the" mean "one or more."

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multiple use fabric conditioning block comprising:

(a) a first side comprising at least one indentation;

(b) a fabric conditioning composition comprising a fabric conditioning component; and a carrier component; and wherein the block is operably connectable to the inside surface of a dryer; and wherein said indentation is imprinted, impressed, or stamped on the first side.

2. The block of claim 1, wherein said fabric conditioning composition exhibits a melting point greater than about 90° C.

3. The block of claim 1, wherein said first side comprises at least one cross section comprising:

(a) an outline course of said cross section; wherein the outline course comprises a starting point, an end point, and a plurality of successive points between the starting point and end point; and (b) a tangent at each successive point beginning at the starting point and ending at the end point; wherein the tangents of the outline course comprising a direction of rotation; and wherein the direction of rotation changes at least once thereby indicating said indentation.

4. The block of claim 3, wherein the direction of rotation changes at least twice.

5. The block of claim 1, wherein said indentation has a depth of up to about 90% of the thickness of the block.

6. The block of claim 1, wherein said indentation has a depth of from about 1 mm to about 20 mm.

7. The block of claim 1, wherein said indentation comprises an indicium.

8. The block of claim 7, wherein said indicium comprise geometrical design and/or shape.

9. The block of claim 7, wherein said indicium is chosen from word, phrase, letter, character, brand name, company name, company logo or symbol, description, logo, icon, perfume name, design, designer name, company name, company logo, symbol, motif, insignia, figure, mark, signal, texture, shape, advertisement, or combinations thereof.

10. The block of claim 9, wherein said indicium is chosen from word, phrase, letter, character, brand name, company name, company logo, perfume name, description, or combinations thereof, and wherein said indicium is in one or more than one language.

11. The block of claim 1, wherein said fabric conditioning composition further comprises a perfume component comprising at least one of:

(a) a low volatile perfume composition comprising at least about 25%, by weight of said perfume component, of perfume ingredients having a boiling point equal to or higher than about 240° C.;

(b) a perfume microcapsule comprising a perfume carrier and an encapsulated perfume composition;

(c) a pro-perfume;

(d) a low odor detection threshold perfume ingredients; and (e) mixtures thereof.

12. The block of claim 1, wherein said block is operably connected to a block carrier.

13. The block of claim 1, wherein the multiple use is at least ten dryer cycles.

14. A method of softening a fabric comprising the step of contacting said fabric with a multiple use fabric conditioning block according to claim 1.

* * * * *